US008057735B2

(12) United States Patent
Deng et al.

(10) Patent No.: US 8,057,735 B2
(45) Date of Patent: Nov. 15, 2011

(54) CENTER BACKFIRE INNER HEAT REGENERATIVE ENERGY SAVING HIGH EFFICIENCY FURNACE AND TANK INTEGRATION REDUCTION FURNACE SYSTEM

(76) Inventors: Xiao-Bao Deng, LuoHu District (CN); Qi-Ming Li, FuTian District (CN); Mike Li, FuTian District (CN); Hua Deng, LuoHu District (CN)

( * ) Notice: Subject to any disclaimer, the term of this patent is extended or adjusted under 35 U.S.C. 154(b) by 316 days.

(21) Appl. No.: 12/425,369

(22) Filed: Apr. 16, 2009

(65) Prior Publication Data

US 2010/0164149 A1 Jul. 1, 2010

(30) Foreign Application Priority Data

Dec. 31, 2008 (CN) ..... 2008 1 0241776

(51) Int. Cl.
*C21B 9/14* (2006.01)

(52) U.S. Cl. ..... 266/171; 266/208

(58) Field of Classification Search ..... 266/171, 266/149, 208
See application file for complete search history.

(56) References Cited

U.S. PATENT DOCUMENTS 4,015,978 A * 4/1977 Matsushima et al. ..... 75/314
7,753,987 B2 * 7/2010 Du et al. ..... 266/149

* cited by examiner

*Primary Examiner* — Scott Kastler

(57) ABSTRACT

A center backfire inner heat regenerative energy saving high efficiency furnace and tank integration reduction furnace system comprises a furnace section and a heating section. The furnace section includes a reduction tank, a material inlet door, a magnesium crystal collecting machine, and a residue exhaust pipe. The reduction tank includes a tank body, a centre combustion room, and plural fume exhaust pipes. The material inlet door is connected to a material charging room between the center combustion room and the tank body, and the magnesium crystal collecting machine is provided with a crystal cover communicating with the material charging room, and a water recycling condensation equipment outside the crystal cover. The residue exhaust pipe is connected to the material charging room and provided with a residue exhaust door and a water dispersing heat separating cover. The heating section includes a burner connected to the center combustion room.

15 Claims, 5 Drawing Sheets

CENTER BACKFIRE INNER HEAT REGENERATIVE ENERGY SAVING HIGH EFFICIENCY FURNACE AND TANK INTEGRATION REDUCTION FURNACE SYSTEM

BACKGROUND OF THE INVENTION

1. Field of the Invention

This invention refers to a metal reducing furnace, and more particularly to a center backfire inner heat regenerative energy saving high efficiency furnace and tank integration reduction furnace system which is used for refining magnesium.

2. Description of the Prior Art

The traditional magnesium refining technology is called Pidgeon which uses a horizontal furnace. Plural reduction tanks are distributed horizontally inside the furnace. The reduction tanks are filled up with reactant pellet. Firstly the reduction tanks are heated up by the outside radiant heat of reverberator, afterwards the reduction tanks transmit the heat radiation to the reactant pellet, and then the pellet mutually relay transmits heat. This is a peripheral heating (as shown in FIG. 5). If using this kind of heating method, continuous experiments prove that the heat transmission rate is low within the reduction tank, the temperature gradient is high, the temperature evenness is not good, and the transmission diameter of the heat radiation is big. Because of the above reasons, it takes a long period of time (10-12 hours a cycle) to let the material within the tank reach its reduction temperature (1150-1200° C.). Besides that, the volume of the reduction tank is too small and every time it can only stuff several hundred kilograms of material. It needs more furnaces and tanks to reach the production requirement. The method of Piegeon has many drawbacks, such as low efficiency, high labor intensity, energy consuming, low yielding of the magnesium, and environmental pollution.

SUMMARY OF THE INVENTION

The primary objective of the present invention is to provide a center backfire inner heat regenerative energy saving high efficiency furnace and tank integration reduction furnace system which comprises a reduction tank capable of realizing center inner combustion and multipass inner heat accumulation. The present invention realizes the integration furnace and tank and the inner heating mode, fundamentally changing the traditional configuration of one furnace with multiple tanks and the heating mode of peripheral radiation. In the present invention, heat radiates and transfers inside out from high temperature zone, the diameter of the heat radiation is smaller, and the temperature inside the tank tends to be even, the gradient temperature difference reduces, the speed of heating up the material increases, and the reduction rate increases. In addition, the present invention accumulates and recycles the waste heat of the high temperate fume to heat up normal temperature combustion-supporting air and fuel. Experiments prove that the temperature transmission speed rate of the material inside the reduction furnace determines the production efficiency. With the present invention, the heat efficiency is remarkably increased, and the heating-up time is greatly reduced, thus solving the drawbacks of the existing magnesium reduction furnace.

In order to achieve the above objectives, a center backfire inner heat regenerative energy saving high efficiency furnace and tank integration reduction furnace system in accordance with the present invention comprises a furnace section and a heating section, characterized in that:

The furnace section includes a reduction tank, a material inlet door, a magnesium crystal collecting machine and a residue exhaust pipe.

The reduction tank includes a ripple tank body, a centre combustion room (internal furnace), plural fume exhaust pipes, wherein the center combustion room is disposed inside the reduction tank, a material charging room is disposed between the centre combustion room and the tank body, the fume exhaust pipes are disposed inside the material charging room, a lower end of the respective fume exhaust pipes communicates with a lower end of the center combustion room, and an upper end of the respective fume exhaust pipes communicates with a fume room.

The material inlet door is connected to the material charging room;

The magnesium crystal collecting machine is interiorly provided with a crystal cover communicating with the material charging room, a water recycling condensation equipment is disposed outside the crystal cover, and the cover is made of carbon and natrium and disposed in the crystal collecting machine to collect magnesium in such a manner that when magnesium vapor entering the crystal collecting machine cools down, it will become magnesium crystal clung to the crystal cover; and The residue exhaust pipe has an upper end connected to the material charging room, and a lower end provided with a residue discharge door, and a water dispersing heat separating cover is disposed on the residue exhaust pipe;

The heating section includes a burner connected to a top of the center combustion room, after pre-mixing air and fuel, the burner will ignite a mixture of the air and fuel with high voltage spark and then eject it into the center combustion room to combust therein.

An inner wall of the reduction tank is covered with an insulating layer, and an upper end of the reduction tank is suspended from a steelwork rack.

A lower end of the reduction tank is installed on a lower supporting rack and provided with a chain wheel tray, and the lower supporting rack is provided with an arc track, plural steel balls are disposed between the chain wheel tray and the arc track as supporting points for rotation of the tank body, when charging or discharging material, the tank body rotates centrifugally or centripetally smaller than 360 degrees.

The reduction tank is provided with a vibrator on the residue exhaust pipe to drive the reduction tank to shake, and a rotary mechanism to drive the tank body to rotate smaller than 360 degrees.

A top of the reduction tank is provided with two heat accumulators communicating with the fume room inside the reduction tank, the two heat accumulators alternately accumulate and exchange heat.

The fume room is disposed between the top of the reduction tank and the fume exhaust pipes and supplies a preheated combustion-supporting air to the burner through the heat accumulators, direction-changing valves and fans.

The fume exhaust pipes are distributed evenly around a circumference of the center combustion room and are arranged in one layer or more, when being arranged in two layers or more, the fume exhaust pipes are arranged in a staggered manner around the circumference of the center combustion room.

The respective fume exhaust pipes are provided with plural staggered conduct heat slices on a circumferential surface thereof.

When the plural fume exhaust pipes are arranged in more than one layer, the lower ends of the fume exhaust pipes of each layer are connected to a lower end of the center combustion room, and the upper ends of the fume exhaust pipes of each layer are connected to an outside fume room.

The reduction tank is exteriorly provided with an insulating cover, an outside fume room is disposed between the tank body and the insulating cover, and two heat accumulators are disposed at a lower end of the outside fume room and alternately accumulate heat and exchange heat.

When the plural fume exhaust pipes are arranged in two layers or more, the lower ends of the fume exhaust pipes of an innermost layer are connected to the lower end of the center combustion room, the upper ends of the fume exhaust pipes of an outermost layer are connected to the fume room, and the lower ends of the fume exhaust pipes of the outermost layer are connected to the outside fume room.

A top of the insulating cover is provided with the burner connected to the outside fume room.

The tank body includes a lower tank body and a tank body seal, the tank body seal is connected to the lower tank body through a flange, the material inlet door, the magnesium crystal collecting machine, the center combustion room, the fume exhaust pipes, and the heat accumulators are connected to the tank body seal, the center combustion room and the fume exhaust pipes are dismantled and installed through the tank body seal.

The present invention has significant economic efficiency: The present invention realizes the integration, mechanization and intelligentization of furnace and reduction tank and utilizes PLC program and CRT display to control and monitor every main points of the working situation. Traditionally, each furnace is equipped with 50 stainless steel made reduction tanks that totally need 35 tons of stainless. However, as compared to the traditional configuration of furnace and reduction furnace, the present invention using the technology of furnace and tank integration can save 90 percent of the stainless steel material of the reduction tank, ⅔ of the labor and 60 percent of the energy (fuel, coal and gas) under the same production amount as the traditional method or even above the traditional production amount and greatly reduce the reduction cycle (The traditional reduction cycle is 12 hours, the reduction cycle of the present invention is about 4 hours), thus solving the problems of low heat efficiency, low production efficiency, without automation and mechanization, high labor intensive and environmental pollution and achieving the objectives of mechanization, automation, energy saving, high efficiency and high production for refining the metal of magnesium using heating method.

DETAILED DESCRIPTION OF THE PREFERRED EMBODIMENTS

Figure 1:
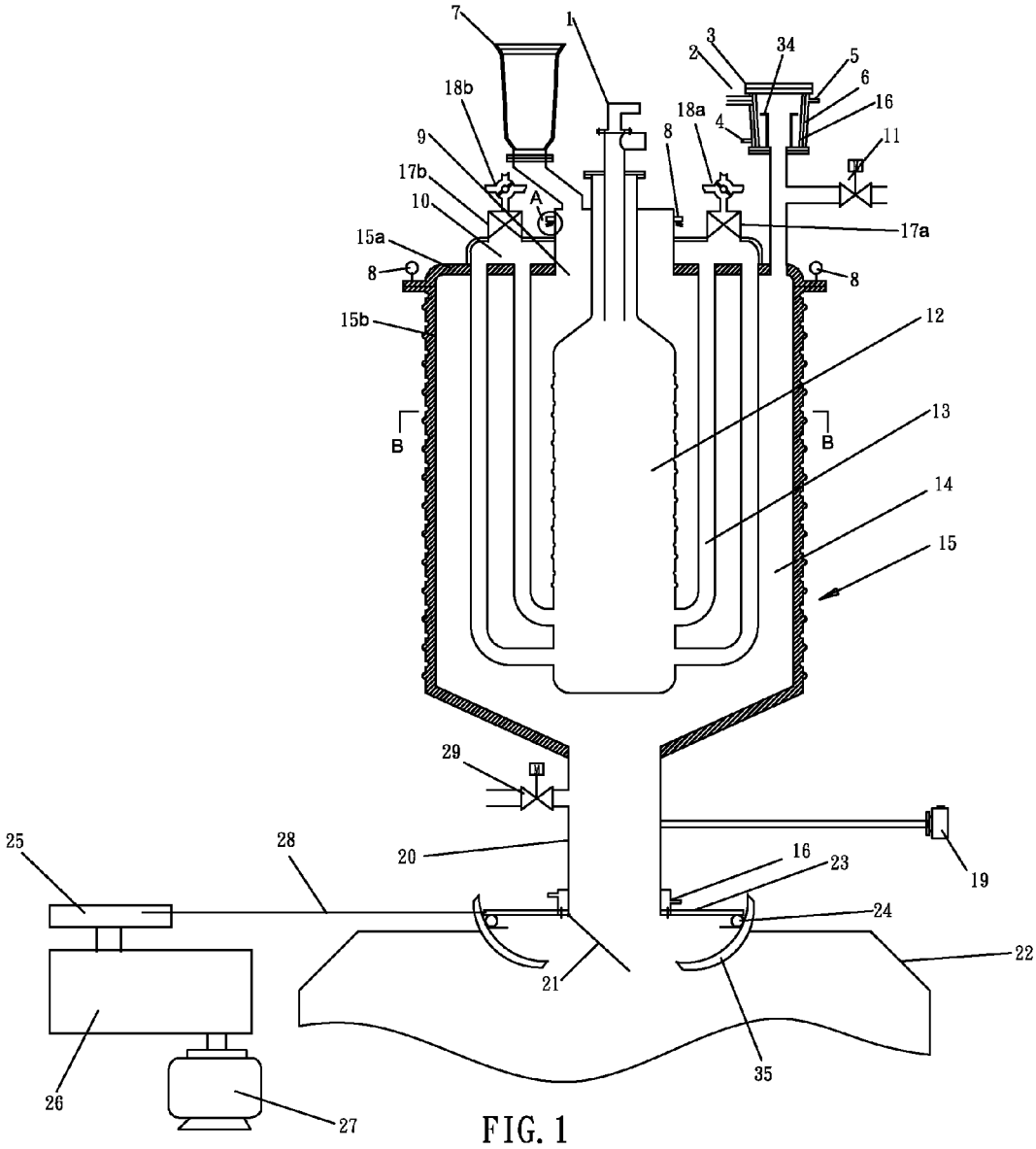
FIG. 1 is a schematic view of a structure of the present invention, showing that the lower ends of the fume exhaust pipes are connected to the lower end of the center combustion room.

The present invention will be clearer from the following description when viewed together with the accompanying drawings, which show, for purpose of illustrations only, the preferred embodiment in accordance with the present invention.

Embodiment 1

A center backfire inner heat regenerative energy saving high efficiency furnace and tank integration reduction furnace system in accordance with the present invention is an upright magnesium refinery furnace and comprises a reduction tank 15, a burner 1, a magnesium crystal collecting machine 6, and a material inlet door 7. The reduction tank 15 includes a ripple tank body made from metal. The tank body consists of a tank body seal 15*a* and a lower tank body 15*b*. The tank body seal 15*a* is connected to the top of the lower tank body 15*b* through a connecting flange. The inner wall of the tank body has an insulating layer which is resistant to high temperature. At a center of the tank body is disposed a center combustion room (internal furnace) 12. Between the inner wall of the tank body and the center combustion room 12 is disposed a material charging room 14. The material charging room 14 which is disposed around the center combustion room 12 is interiorly provided with plural fume exhaust pipes 13. The plural fume exhaust pipes 13 are arranged in two layers (or in multiple layers according to the volume of the reduction tank). The material charging room 14 which is disposed around the fume exhaust pipe 13 is stuffed with the magnesium pellet. Above the fume exhaust pipe 13 is disposed a fume room 10 having an inner insulating layer. The lower ends of the two layers of fume exhaust pipes 13 are connected to the lower end of the center combustion room 12, respectively. The upper ends of the fume exhaust pipes 13 communicate with the fume room 10. When there are two layers of the fume exhaust pipes 13, the fume exhaust pipes 13 are arranged in a staggered manner for facilitating even heat dissipation of the fume exhaust pipes 13 in the material charging room 14. When there are two or more layers of the fume exhaust pipes 13, the fume exhaust pipes 13 can be arranged in series, namely, the hot fume goes in from the lower ends of the fume exhaust pipes of the innermost layer, exhausts to the fume room 10 through the upper ends of the fume exhaust pipes of the innermost layer, and then enters the upper ends of the pipes of the next layer, so on and so on. In order to improve the heat dissipation efficiency rate of the fume exhaust pipes 13, the circumferential surface of the respective fume exhaust pipes 13 is distributed with plural staggered metal conduct heat slices. Staggered distribution is good for dispersing heat evenly and distributing the magnesium pellet evenly.

The top of the center combustion room 12 is connected to the burner 1, which can burn liquids (patrol, diesel and etc.) and gas (liquefied gas, natural gas, etc.). The burner 1 can directly eject a flammable gas into the combustion room 12 to combust therein to heat up the combustion room 12 directly.

The reduction tank 15 is provided with a residue exhaust pipe 20 at the lower end thereof. The lower end of the residue exhaust pipe 20 is provided with the residue discharge door 21, which is used to exhaust the waste residue after refining the magnesium.

The tank body is provided with a material inlet pipe 9 on the top thereof. The upper end of the material inlet pipe 9 is connected to an inlet door 7, and the lower end of the material inlet pipe 9 is connected to the material charging room 14.

The tank body is further provided on the top thereof with a magnesium crystal collecting machine 6 that is connected to the material charging room 14. Inside the collecting machine 6 is disposed a water cycle condensation machine 3. The collecting machine 6 includes a secondary evacuation joint 2, a water inlet door 4, and a water outlet door 5. The evacuation joint 2 is connected to a vacuum pump. The water inlet door 4 is connected to the cool water. When the magnesium pellet is heated up to 1100-1200° C., the magnesium gas will go into the magnesium crystallite collecting machine 6 through the function of the vacuum pump. After being cooled by the water cycle condensation machine 3, the magnesium gas will crystallize into magnesium crystal inside a crystal cover (not shown) in the collecting machine 6. The cover is made of carbon and natrium and disposed in the crystal collecting machine 6 to collect magnesium in such a manner that when magnesium vapor entering the crystal collecting machine cools down, it will become magnesium crystal clung to the crystal cover. A connecting pipe of the collecting machine 6 and the reduction tank 15 is provided with a primary evacuation joint with an electromagnetic valve 11.

The tank body is further provided on the top thereof with a system for utilizing residual heat and supplying wind, which includes a regenerative room. Inside the regenerative room are disposed two heat accumulators 17*a* and 17*b*. Through two combustion-supporting direction-changing valves 18*a*, 18*b*, the accumulators 17*a* and 17*b* are connected to the heat-exchange inducing fans (not shown), and air blowers (not shown) to tangentially supply or induce wind to the burner and change the direction of wind, utilizing high temperature fume to heat up combustion-supporting air. The heat accumulators 17*a* and 17*b* are employed to both send hot fume from the fume room 10 to the burner 1 and send air and oxygen to the burner 1 through the direction-changing valves 18*a*, 18*b*.

The tank body is provided with a rotary mechanism (rebound type rotary power device), which includes a motor 27, a reducer 26, a transmission chain wheel 25. The reducer 26 is connected to a chain wheel tray 23 installed at the lower end of the residual exhaust pipe 20 through the chain wheel 25 and a chain 28. When being driven by the rotary mechanism, the tank body can alternately rotate in clockwise or counterclockwise direction smaller than 360 degrees (by means of electromagnetic valve and rebound spring). In addition, the residue exhaust pipe 20 of the tank body is provided at a side thereof with an electromagnetic vibrator 19 to shake the tank body. While the tank body is rotated and shaken, the magnesium pellet inside the material charging room 14 will turn over and move continuously.

The tank body is installed in such a manner that both its upper end and lower end have a certain degree of freedom, which facilitates rotating and shaking of the tank body. The upper end of the tank body (including the connecting flange between the tank body seal and the lower tank body or the upper end of the center combustion room) can be installed on or suspended from the steelwork rack (not shown) through suspending elements 8 or a combination of a spring 36 and a steel ball 24. The lower end of the reduction tank 15 is installed on a lower supporting rack 22 and provided with the chain wheel tray 23. The lower supporting rack 22 is provided with an arc track 35, and plural steel balls 24 are disposed between the lower supporting rack 22 and the chain wheel tray 23 as points of rotation for the tank body, so that when charging or discharging material, the tank body can rotate centrifugally or centripetally smaller than 360 degrees.

Embodiment 2

Figure 2:
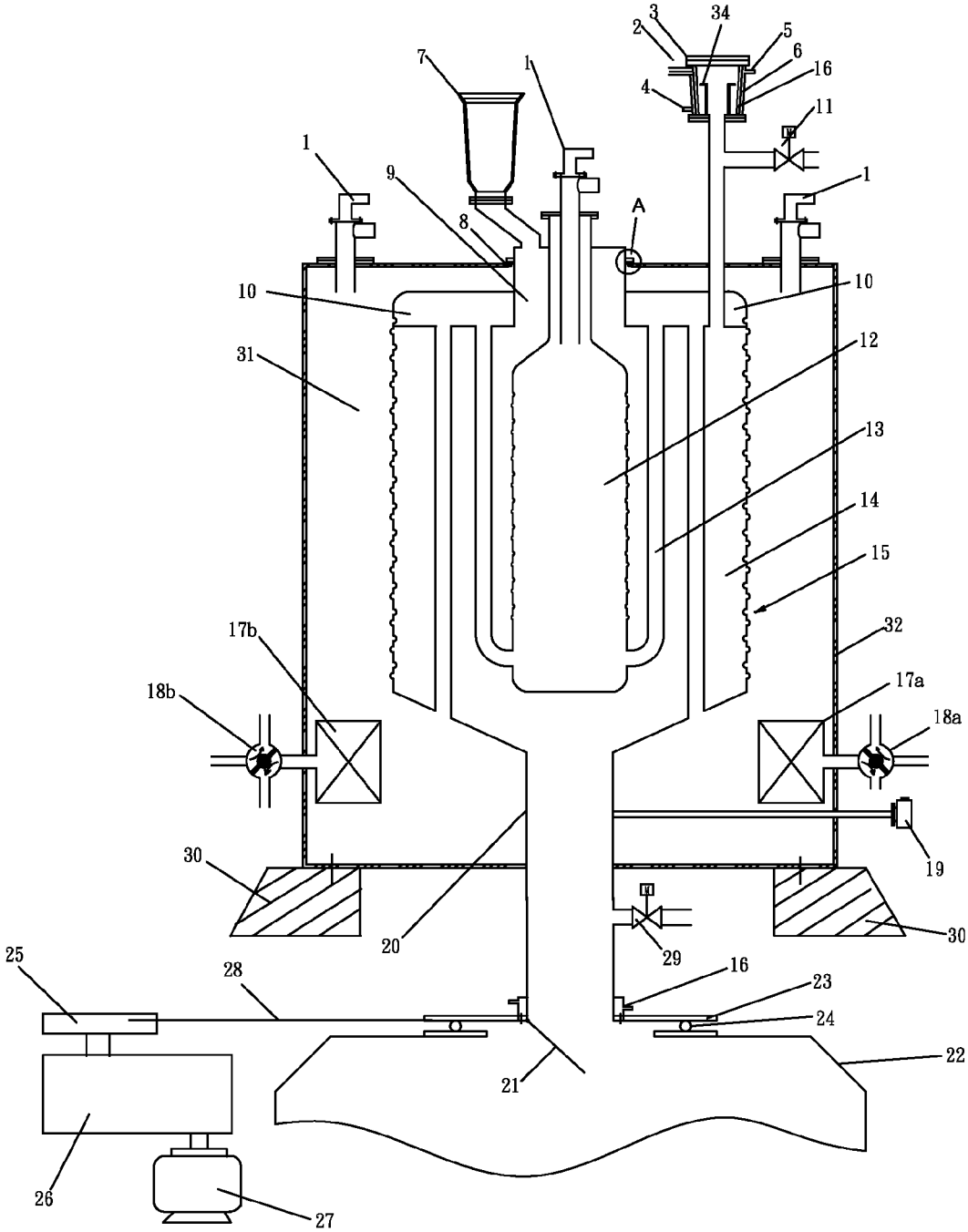
FIG. 2 is a schematic view of another structure of the present invention, showing that the reduction tank is exteriorly provided with an insulating cover, and the lower ends of the fume exhaust pipes of an innermost layer are connected to the lower end of the center combustion room, and the upper ends of the fume exhaust pipes of the remaining layers are connected to a fume room, and the lower ends of the fume exhaust pipes of the remaining layers are connected to an outside fume room.
Figure 3:
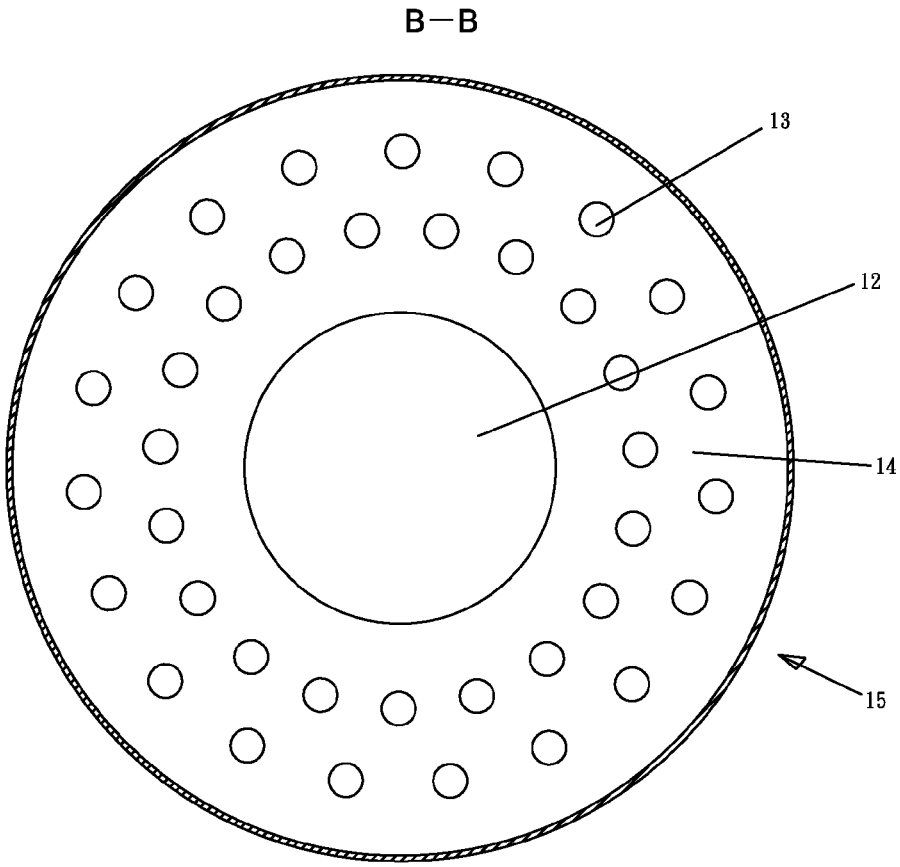
FIG. 3 is a cross sectional view taken along the line B-B of FIG. 1.
Figure 4:
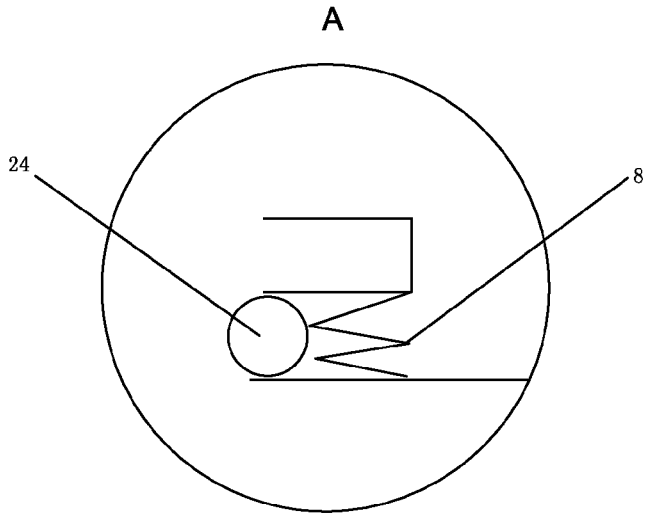
FIG. 4 is an enlarged view of A in FIG. 1.
Figure 5:
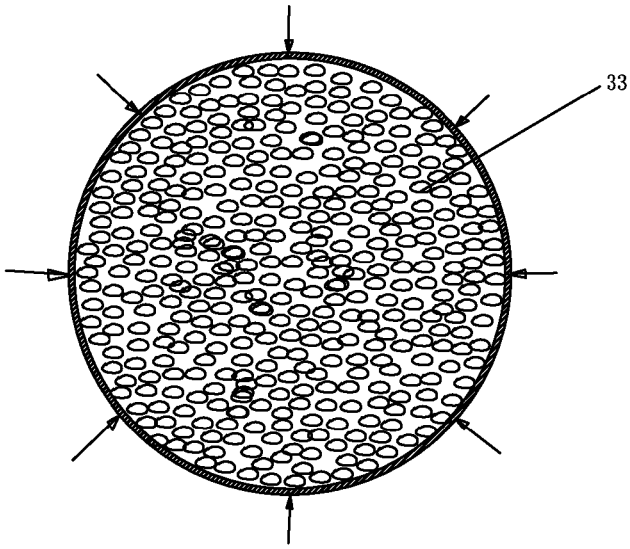
FIG. 5 PRIOR ART
FIG. 5 is a schematic view of heating state of a traditional reduction tank.
Figure 6:
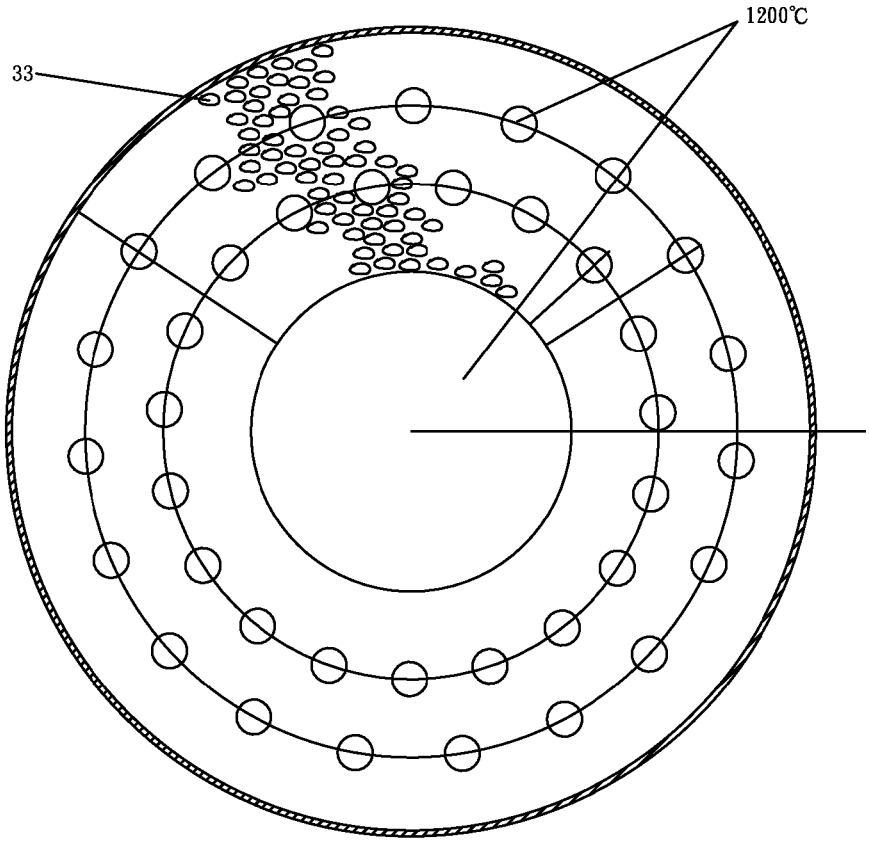
FIG. 6 is a schematic view of heating state of the reduction tank of FIG. 1 in accordance with the present invention.

Referring to FIG. 2, another furnace in accordance with the present invention comprises an insulating cover 32 outside the reduction tank 15. When being provided with the insulating cover 32, the inner wall of the reduction tank does not need the insulating layer. An outside fume room 31 is disposed between the reduction tank 15 and the insulting cover 32. Two heat accumulators 17*a*, 17*b* are located at the lower end of the outside fume room 31 to accumulate and exchange heat alternately. Under the insulating cover 32 is disposed a supporting foundation 30 to fix and support the insulating cover 32. Also, on top of the insulating cover 32 is disposed the burner 1 connected to the outside fume room 31. According to requirements, the quantity of the burners 1 can range from 1 to 4, and these burners 1 are evenly distributed. By adding more burners, interior and exterior of the reduction tank can be heated up at the same time, which can improve the heat efficiency.

Working Principle:

The present invention is capable of providing various constant temperatures below 1200° C. for various technologies, such as thermally refining magnesium, and heating up, drying, thermally decomposing other metals, etc. It can also be used for others which need minus absorption method reduction technology to refine and thermally decompose. The combustion, radiation, transmission and convection in the furnace can enable the materials inside the reduction tank to be heated both interiorly and exteriorly to increase the temperature quickly, which rationally and efficiently utilizes the heat to evenly heat up the material inside the reduction tank.

The present invention is an integration of a furnace and a reduction tank and is directly provided with a burner system inside the reduction tank to radiate, transmit, and convert heat from inside to outside. Further, the present invention is provided with an outside combustion assisting system to assist combustion, absorb heat, accumulate heat, and recycle preheat combustion-supporting air, thus achieving the combustion of high temperature and low amount of air index and the best combustion effect.

Figure 7:
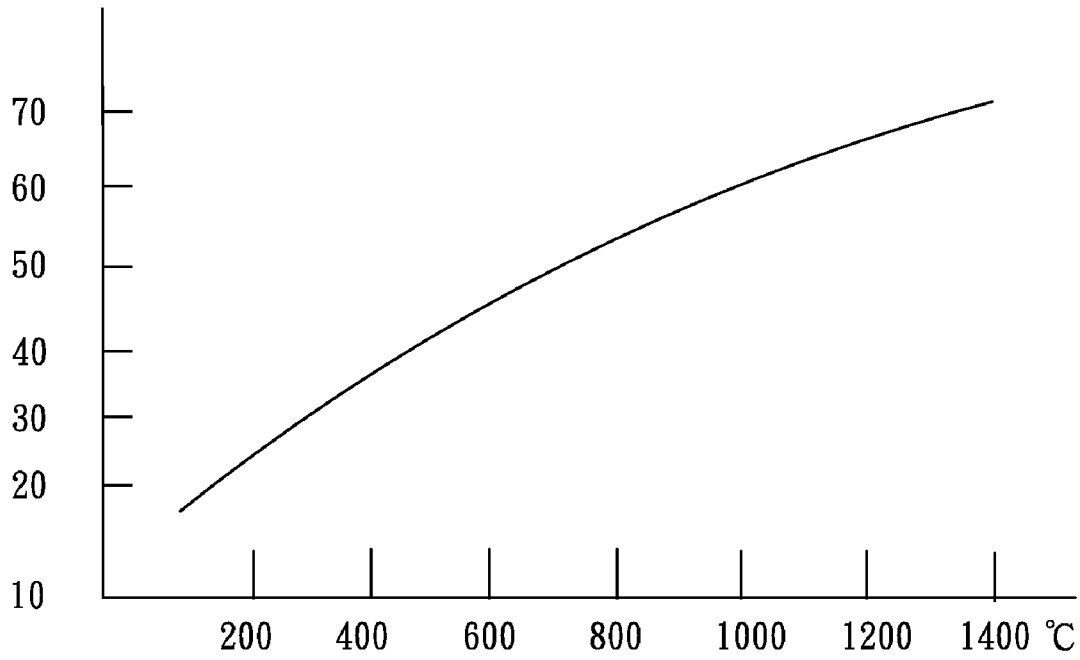
FIG. 7 is a chart illustrating a relationship between regenerative pre-heating combustion-supporting air temperature and fuel saving ratio; wherein numbers 10-70 represent the fuel saving ratio %, and numbers 200-1400 represent the regenerative pre-heating combustion-supporting air temperature ° C.

After pre-mixing air and fuel, the burner will eject the mixture of air and fuel into the internal furnace of the tank body to combust therein. Through the first pass fume exhaust pipes, the fume generated from the combustion in the internal furnace radiates heat from inside to outside to heat up the material in the reduction tank, and when passing through the second pass fume exhaust pipes, the high temperature fume continues heating up the material. After that, the high temperature fume will enter a fume room and then go into the third pass fume exhaust pipes to heat up the material continuously. After passing through the third pass fume exhaust pipes, the high temperature fume will enter an outside fume room of the reduction tank to heat up the exterior of the reduction tank. Meanwhile, the heat accumulators disposed in the outside fume room will accumulate and exchange heat and recycle the waste heat to pre-heat up the combustion-supporting air and the flammable gas circularly from the ambient temperature to 800-1000° C. After exchanging heat with the heat accumulators, the waste gas generated from combustion will be exhausted with the temperature smaller than 150° C. (The temperature of the fume exhausted from the traditional old fashioned furnace ranges from 1000 to 1100° C.), as shown in FIG. 7, illustrating a relationship of preheating air temperature and fuel saving ratio.

The furnace body section is a combined structure, namely, the furnace body consists of a tank body seal and a lower tank body. Such a configuration facilitates the installation and dismantlement of the inner center combustion room (internal furnace) and the fume exhaust pipes. When the center combustion room (internal furnace) and the fume exhaust pipe are damaged, it only needs to open the tank body seal, take out the center combustion room (internal furnace) and the fume exhaust pipe, and then replace them with a new one or repair them, thus preventing the tank body section from being scrapped.

While we have shown and described various embodiments in accordance with the present invention, it is clear to those skilled in the art that further embodiments may be made without departing from the scope of the present invention.

What is claimed is:

1. A center backfire inner heat regenerative energy saving high efficiency furnace and tank integration reduction furnace system, comprising a furnace section and a heating section, characterized in that:

the furnace section includes a reduction tank, a material inlet door, a magnesium crystal collecting machine and a residue exhaust pipe; wherein:

the reduction tank includes a tank body, a centre combustion room, plural fume exhaust pipes, wherein the center combustion room is disposed inside the reduction tank, a material charging room is disposed between the centre combustion room and the tank body, the fume exhaust pipes are disposed inside the material charging room, a lower end of the respective fume exhaust pipes communicates with a lower end of the center combustion room, and an upper end of the respective fume exhaust pipes communicates with a fume room;

the material inlet door is connected to the material charging room;

the magnesium crystal collecting machine is interiorly provided with a crystal cover communicating with the material charging room, the cover is made of carbon and natrium to collect magnesium in such a manner that when magnesium vapor entering the crystal collecting machine cools down, the magnesium vapor will become magnesium crystal clung to the crystal cover, a water recycling condensation equipment is disposed outside the crystal cover; and the residue exhaust pipe has an upper end connected to the material charging room, and a lower end provided with a residue discharge door, and a water dispersing heat separating cover is disposed on the residue exhaust pipe;

the heating section includes a burner connected to a top of the center combustion room, after pre-mixing air and fuel, the burner will ignite a mixture of the air and fuel with high voltage spark and then eject it into the center combustion room to combust therein.

2. The center backfire inner heat regenerative energy saving high efficiency furnace and tank integration reduction furnace system as claimed in claim 1, characterized in that an inner wall of the reduction tank is covered with an insulating layer, and an upper end of the reduction tank is suspended from a steelwork rack.

3. The center backfire inner heat regenerative energy saving high efficiency furnace and tank integration reduction furnace system as claimed in claim 1, characterized in that a lower end of the reduction tank is installed on a lower supporting rack and provided with a chain wheel tray, and the lower supporting rack is provided with an arc track, plural steel balls are disposed between the chain wheel tray and the arc track as supporting points for rotation of the tank body, when charging or discharging material, the tank body rotates centrifugally or centripetally smaller than 360 degrees.

4. The center backfire inner heat regenerative energy saving high efficiency furnace and tank integration reduction furnace system as claimed in claim 1, characterized in that the reduction tank is provided with a vibrator on the residue exhaust pipe to drive the reduction tank to shake, and a rotary mechanism to drive the tank body to rotate smaller than 360 degrees.

5. The center backfire inner heat regenerative energy saving high efficiency furnace and tank integration reduction furnace system as claimed in claim 1, characterized in that a top of the reduction tank is provided with two heat accumulators communicating with the fume room inside the reduction tank, the two heat accumulators alternately accumulate and exchange heat.

6. The center backfire inner heat regenerative energy saving high efficiency furnace and tank integration reduction furnace system as claimed in claim 1, characterized in that, the fume room is disposed between the top of the reduction tank and the fume exhaust pipes and supplies a pre-heated combustion-supporting air to the burner through the heat accumulators, direction-changing valves and fans.

7. The centre backfire inner heat regenerative energy saving high efficiency furnace and tank integration reduction furnace system as claimed in claim 1, characterized in that the fume exhaust pipes are distributed evenly around a circumference of the center combustion room and are arranged in one layer or more, when being arranged in two layers or more, the fume exhaust pipes are arranged in a staggered manner around the circumference of the center combustion room.

8. The center backfire inner heat regenerative energy saving high efficiency furnace and tank integration reduction furnace system as claimed in claim 1, characterized in that the respective fume exhaust pipes are provided with plural staggered conduct heat slices on a circumferential surface thereof.

9. The center backfire inner heat regenerative energy saving high efficiency furnace and tank integration reduction furnace system as claimed in claim 7, characterized in that the respective fume exhaust pipe are provided with plural staggered conduct heat slices on a circumferential surface thereof.

10. The center backfire inner heat regenerative energy saving high efficiency furnace and tank integration reduction furnace system as claimed in claim 1, characterized in that when the plural fume exhaust pipes are arranged in more than one layer, the lower ends of the fume exhaust pipes of each layer are connected to a lower end of the center combustion room, and the upper ends of the fume exhaust pipes of each layer are connected to an outside fume room.

11. The center backfire inner heat regenerative energy saving high efficiency furnace and tank integration reduction furnace system as claimed in claim 7, characterized in that when the plural fume exhaust pipes are arranged in more than one layer, the lower ends of the fume exhaust pipes of each layer are connected to a lower end of the center combustion room, and the upper ends of the fume exhaust pipes of each layer are connected to an outside fume room.

12. The center backfire inner heat regenerative energy saving high efficiency furnace and tank integration reduction furnace system as claimed in claim 1, characterized in that the reduction tank is exteriorly provided with an insulating cover, an outside fume room is disposed between the tank body and the insulating cover, and two heat accumulators are disposed at a lower end of the outside fume room and alternately accumulate heat and exchange heat.

13. The center backfire inner heat regenerative energy saving high efficiency furnace and tank integration reduction furnace system as claimed in claim 12, characterized in that when the plural fume exhaust pipes are arranged in two layers or more, the lower ends of the fume exhaust pipes of an innermost layer are connected to the lower end of the center combustion room, the upper ends of the fume exhaust pipes of an outermost layer are connected to the fume room, and the lower ends of the fume exhaust pipes of the outermost layer are connected to the outside fume room.

14. The center backfire inner heat regenerative energy saving high efficiency furnace and tank integration reduction furnace system as claimed in claim 12, characterized in that a top of the insulating cover is provided with the burner connected to the outside fume room.

15. The center backfire inner heat regenerative energy saving high efficiency furnace and tank integration reduction furnace system as claimed in claim 1, characterized in that the tank body includes a lower tank body and a tank body seal, the tank body seal is connected to the lower tank body through a flange, the material inlet door, the magnesium crystal collecting machine, the center combustion room, the fume exhaust pipes, and the heat accumulators are connected to the tank body seal, the center combustion room and the fume exhaust pipes are dismantled and installed through the tank body seal.

* * * * *